US009921020B2

(12) United States Patent
Latka

(10) Patent No.: US 9,921,020 B2
(45) Date of Patent: Mar. 20, 2018

(54) SOUND SUPPRESSOR WITH REPLACEABLE COMPONENTS

(71) Applicant: GSL TECHNOLOGY, INC., Jackson, MI (US)

(72) Inventor: Gregory S. Latka, Jackson, MI (US)

(73) Assignee: GSL Technology, Inc., Jackson, MI (US)

( * ) Notice: Subject to any disclaimer, the term of this patent is extended or adjusted under 35 U.S.C. 154(b) by 0 days.

(21) Appl. No.: 15/174,235

(22) Filed: Jun. 6, 2016

(65) Prior Publication Data

US 2017/0350669 A1 Dec. 7, 2017

(51) Int. Cl.
*F41A 21/30* (2006.01)

(52) U.S. Cl.
CPC ..... *F41A 21/30* (2013.01)

(58) Field of Classification Search
CPC ..... F41A 21/28; F41A 21/30; F41A 21/32; F41A 21/34
USPC ..... 89/14.4, 14.2, 14.3; 42/77
See application file for complete search history.

(56) References Cited

U.S. PATENT DOCUMENTS 1,111,202 A 9/1914 Westfall
1,259,251 A 3/1918 Love
1,605,864 A 11/1926 Steinegger
2,499,428 A * 3/1950 Belle ..... F41A 21/36 89/14.3
2,870,679 A 1/1959 Collins
2,900,875 A 8/1959 Fergus et al.
3,385,164 A * 5/1968 Hubner ..... F41A 21/30 181/223
3,500,955 A 3/1970 Werbell
3,667,570 A 6/1972 Werbell, III
3,748,956 A * 7/1973 Hubner ..... F41A 21/30 89/14.4
4,024,791 A 5/1977 Stratman
4,291,610 A * 9/1981 Waiser ..... F41A 21/30 89/14.4
4,341,283 A * 7/1982 Mazzanti ..... F01N 1/06 181/223
4,576,083 A * 3/1986 Seberger, Jr. ..... F01N 1/08 181/223
4,584,924 A 4/1986 Taguchi
4,588,043 A 5/1986 Finn
4,664,014 A 5/1987 Hawley et al.
5,029,512 A 7/1991 Latka
5,164,535 A * 11/1992 Leasure ..... F41A 21/30 181/223
5,559,302 A 9/1996 Latka
5,596,161 A 1/1997 Sommers
5,679,916 A * 10/1997 Weichert ..... F41A 21/30 181/223

(Continued)

*Primary Examiner* — Jonathan C Weber
(74) *Attorney, Agent, or Firm* — Young Basile Hanlon & MacFarlane, P.C.

(57) ABSTRACT

A sound suppressor having a housing and a baffle. The housing is integrally formed and has an outer surface, an inner surface, and a bore. The bore of the housing is defined by the inner surface of the housing and extends longitudinally. A serial number for the sound suppressor is provided on the outer surface of the housing. The baffle is removable from the housing and has an annulus. The annulus of the baffle is in communication with the inner surface of the housing when the baffle is at least partially disposed within the bore of the housing.

11 Claims, 2 Drawing Sheets

(56) References Cited

U.S. PATENT DOCUMENTS 5,685,102 A 11/1997 Latka
6,302,009 B1 10/2001 O'Quinn et al.
6,308,609 B1 10/2001 Davies
6,374,718 B1 * 4/2002 Rescigno ..... F41A 21/30 89/14.4
6,425,310 B1 7/2002 Champion
6,575,074 B1 6/2003 Gaddini
6,837,139 B2 1/2005 Meyers
6,848,538 B2 * 2/2005 Shafer ..... F41B 11/00 181/223
7,073,426 B1 7/2006 White
7,237,467 B1 7/2007 Melton
7,302,774 B2 12/2007 Meyers
7,308,967 B1 12/2007 Noel
7,325,474 B2 2/2008 Yoshimura et al.
7,587,969 B2 9/2009 Silvers
7,789,008 B2 9/2010 Petersen
7,856,914 B2 12/2010 Shults et al.
7,861,636 B1 1/2011 Hoffman
7,874,238 B2 1/2011 Silvers
7,905,170 B1 3/2011 Brittingham et al.
7,931,118 B1 4/2011 Cronhelm
8,015,908 B2 9/2011 Kline et al.
8,087,338 B1 1/2012 Hines
8,096,222 B2 1/2012 Silvers
8,100,224 B1 1/2012 Olson
8,104,394 B2 1/2012 Meyers
8,104,570 B2 1/2012 Miller et al.
8,162,100 B2 4/2012 Shults et al.
8,167,084 B1 5/2012 Moore
8,171,840 B2 5/2012 Kline et al.
8,210,087 B2 7/2012 Latka
8,292,025 B1 10/2012 Woodell et al.
8,307,946 B1 11/2012 Johnston
8,453,789 B1 6/2013 Honigmann
8,459,405 B1 * 6/2013 Dueck ..... F41A 21/30 181/223
8,522,662 B2 9/2013 Presz et al.
8,528,691 B1 9/2013 Carmichael
8,561,757 B1 * 10/2013 Edsall ..... F41A 21/30 181/223
8,567,556 B2 * 10/2013 Dueck ..... F41A 21/30 181/223
8,579,075 B2 * 11/2013 Brittingham ..... F41A 21/30 181/223
8,857,306 B1 * 10/2014 Edsall ..... F41A 21/30 181/223
8,910,745 B2 12/2014 Latka
8,939,057 B1 * 1/2015 Edsall ..... F41A 21/30 181/223
8,978,818 B2 3/2015 Proske
8,991,551 B2 3/2015 Latka
8,991,552 B2 3/2015 Latka
9,182,188 B2 * 11/2015 Gawencki ..... F41A 21/30
2011/0297477 A1 12/2011 Koumbis
2012/0103176 A1 * 5/2012 Latka ..... F41A 21/30 89/14.4
2012/0272818 A1 11/2012 Dueck
2013/0180150 A1 * 7/2013 Dueck ..... F41A 21/325 42/90
2016/0061551 A1 * 3/2016 Petersen ..... F41A 21/28 89/14.4
2016/0109205 A1 * 4/2016 Coppinger ..... F41A 21/30 89/14.4

* cited by examiner

SOUND SUPPRESSOR WITH REPLACEABLE COMPONENTS

TECHNICAL FIELD

This disclosure relates generally to sound suppressors for firearms, and more particularly to firearm sound suppressors having replaceable components.

BACKGROUND

Firearm sound suppressors can absorb and reduce the audible frequencies and vibrations that result from the rapid expansion of gases leaving the muzzle of the firearm as a projectile exits. This is accomplished by temporarily containing and diverting the rapidly expanding gases and other combustion by-products that are emitted from the muzzle of the firearm in inner chambers of the sound suppressor.

Over time, inner components of the sound suppressor can become damaged by the projectile and/or combustion by-products. However, most high caliber sound suppressors typically have either a mono core design or are welded together. As a result, the damaged components within the sound suppressor cannot be easily repaired or replaced without damaging an outer housing of the sound suppressor. The outer housing of the sound suppressor typically contains a serial number, which the owner of the sound suppressor registers a governmental agency and pays a fee associated with the registration. If the serial number changes during the repair of the sound suppressor, the owner registers the new serial number with the governmental agency and pays the fee for a second time.

SUMMARY

Disclosed herein are sound suppressors for firearms. According to a first embodiment, the sound suppressor has a housing and a baffle. The housing is integrally formed and has an outer surface, an inner surface, and a bore. The bore of the housing is defined by the inner surface of the housing and extends longitudinally. A serial number for the sound suppressor is provided on the outer surface of the housing. The baffle is removable from the housing and has an annulus. The annulus of the baffle is in communication with the inner surface of the housing when the baffle is at least partially disposed within the bore of the housing.

According to a second embodiment, the sound suppressor has a housing, an end piece, and a baffle. The housing has a bore that extends longitudinally from a first end of the housing to a second end of the housing. The end piece has a lip and a bore. The bore of the end piece extends longitudinally from a first end of the end piece to a second end of the end piece. The lip abuts the first end of the housing. The baffle has an axial bore. The baffle abuts the second end of the end piece.

According to a third embodiment, the sound suppressor has a housing, an end piece, a plurality of baffles, and a front cap. The housing is integrally formed and has an outer surface, and inner surface, and a bore. The bore of the housing is defined by the inner surface of the housing and extends longitudinally from a first end of the housing to a second end of the housing. The first end of the housing and the second end of the housing having screw thread. A serial number for the sound suppressor is provided on the outer surface of the housing. The end piece has a lip, screw thread, and a bore. The screw thread on the end piece can engage the screw thread on the first end of the housing. The bore of the end piece extends longitudinally from a first end of the end piece to a second end of the end piece. Each baffle of the plurality of baffles has an annulus and an axial bore. The front cap has screw thread and a bore. The screw thread of the front cap can engage the screw thread on the second end of the housing. The bore of the front cap extends from a first end of the front cap to a second end of the front cap. The end piece, the plurality of baffles, and the front cap are removable from the housing. The lip of the end piece abuts the first end of the housing, the annulus of one baffle from the plurality of baffles abuts the second end of the end piece, and the annulus of another baffle from the plurality of baffles abuts the first end of the front cap when the end piece and the front cap are threaded to the housing.

These and other aspects of the present disclosure are disclosed in the following detailed description of the embodiments, the appended claims and the accompanying figures.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
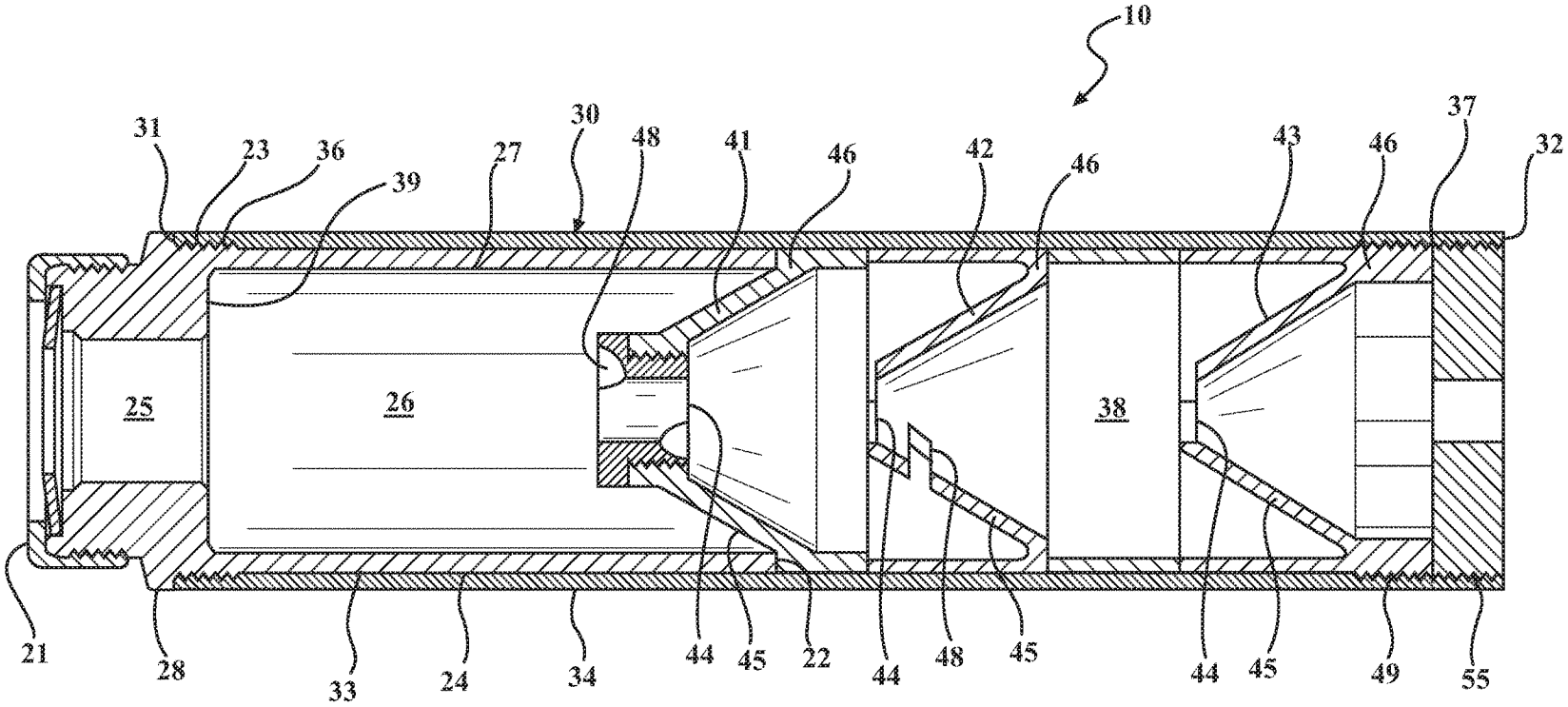
FIG. 1 is a side cross-sectional view of a sound suppressor for a firearm.
Figure 2:
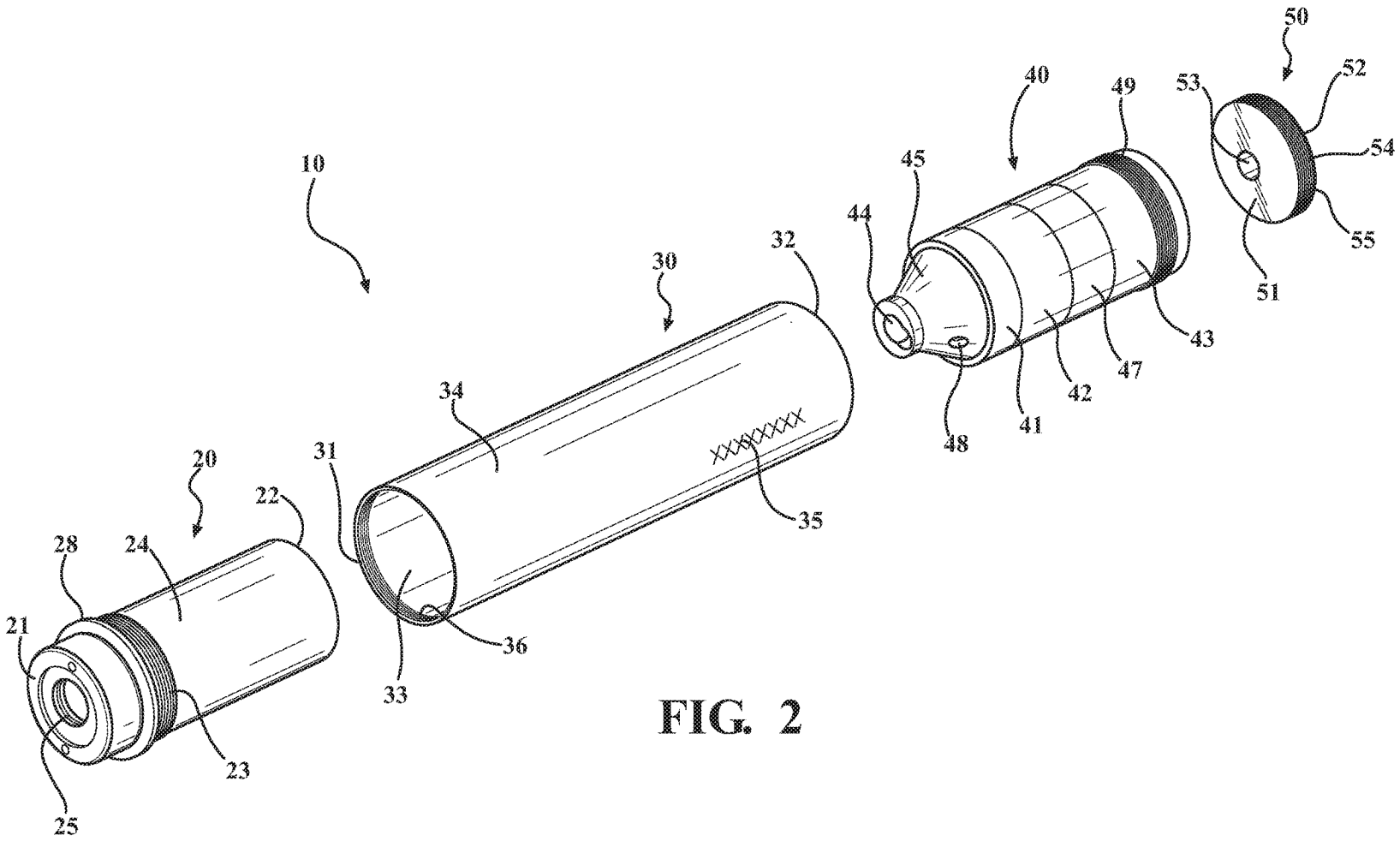
FIG. 2 is a partially exploded, perspective view of the sound suppressor.

A sound suppressor 10 for a firearm is illustrated in FIGS. 1-2. The sound suppressor 10 includes an end piece 20, a housing 30, a baffle core 40, and a front cap 50 that are coaxially aligned so that a projectile (not shown) can enter the sound suppressor 10 through a bore 25 in a first end 21 of the end piece 20 and exit the sound suppressor 10 through a bore 53 in a second end 52 of the front cap 50.

Occasionally components of the end piece 20, the baffle core 40, and/or the front cap 50 need to be repaired or replaced. The sound suppressor 10 is designed so that the damaged component can be repaired or replaced while leaving the housing 30, which can contain a serial number 35, intact. The serial number 35 can be etched into, affixed to, or printed onto an outer surface 34 of the housing 30.

The housing 30 can be integrally formed and have a substantially circular tubular configuration extending longitudinally from a first end 31 to a second end 32. The housing 30 can be implemented using other configurations, such as rectangular, triangular, or polygonal. An inner surface 33 of the housing 30 defines a bore 38 that extends from the first end 31 of the housing 30 to the second end 32 of the housing 30. Screw threads 36, 37 can be formed on or in the inner surface 33 near opposing ends of the housing 30. The screw thread 36 near the first end 31 of the housing 30 engages complementary screw thread 23 formed on or in an outer surface 24 of the end piece 20 to secure the end piece 20 to the housing 30. The screw thread 37 near the second end 32 of the housing 30 can be comprised of two sections, one section to engage the baffle core 40 and the other section to engage the front cap 50 as will be explained. Other engagement mechanisms can be used to secure the end piece 20, the baffle core 40, and the front cap 50 to the housing 30.

Similar to the housing 30, the end piece 20 can have a substantially tubular configuration, although other configurations can be used. When the end piece 20 is disposed within the bore 38 and secured to the housing 30, the first end 31 of the housing 30 can abut a lip 28 that extends radially from the end piece 20. The lip 28 can be integrally formed near the screw thread 23 of the end piece 20.

The first end 21 of the end piece 20 can be configured to attach to a firearm (not shown) so that the bore 25 in the first end 21 is in communication and aligned with a bore (not shown) in a firearm. The bore 25 in the first end 21 is also in communication with a bore 26 that extends through the end piece 20 so that the projectile can continue through the end piece 20 unobstructed. The bore 26 is defined by the inner surface 27 of the end piece 20. Because of the size difference, a shoulder 39 is formed between the bore 25 and the bore 26. As illustrated, the shoulder 39 is positioned near and transverse to the screw thread 23 of the end piece 20.

A second end 22 of the end piece 20 is spaced longitudinally from the first end 21 of the end piece 20. The second end 22 of the end piece 20 is configured such that the second end 22 fits within the housing 30 and the outer surface 24 of the end piece 20 is flush against the inner surface 33 of the housing 30 when the sound suppressor 10 is assembled. One way of accomplishing this is to have the diameter of the inner surface 33 of the housing 30 approximately the same size or slightly larger than the diameter of the outer surface 24 of the end piece 20. The distance between the second end 22 and the lip 28 of the end piece 20 can be approximately 25% to 50% of the length of the housing 30.

When assembled, the baffle core 40 is disposed within the bore 38 of the housing 30. The baffle core 40 includes a plurality of baffles 41-43, which attenuate and capture the flow of combustion gases associated with firing the projectile through the sound suppressor 10. Although three baffles 41-43 are shown, the number and physical characteristics of the baffles 41-43 can vary. Of the three baffles 41-43, baffle 41 is positioned closest to the first end 31 of the housing 30, and baffle 43 is positioned closest to the second end 32 of the housing 30. Baffle 42 is positioned between baffle 41 and baffle 42. Each baffle 41-43 can have an axial bore 44, a frusto-conical section 45, and an annulus 46. As shown, the apexes of frusto-conical sections 45 of the baffles 41-43 are disposed toward the bore 25 in the end piece 20. Each axial bore 44 is large enough and coaxially aligned to accommodate passage of the projectile through the baffle core 40. Each annulus 46 is connected to its respective frusto-conical section 45 and can be extend longitudinally in either direction. As shown, the annulus 46 of baffle 41 extends from its frusto-conical section 45 in a direction that is away from the bore 25, and the annulus 46 of baffle 42 extends from its frusto-conical section 45 in a direction that is toward the bore 25. The annulus 46 of baffle 43 extends from its frusto-conical section 45 in both directions.

The baffles 41-43 can be formed by casting, machining, or stamping and are manufactured so as to ensure a precise fit between the outer circumference of the annuli 46 and the circumference of the inner surface 33 of the housing 30. By closely fitting the annuli 46 to the inner surface 33 of the housing 30, expanding gases, combustion by-products, and sound energy can be prevented from passing between the annuli 46 and the housing 30, which thereby increases the effectiveness that the sound suppressor 10 can suppress noise and muzzle flash.

The baffles 41-43 can be spaced apart by one or more spacers 47. The spacers 47 can be formed as a separate unit or integrally formed as part of a baffle 41-43. As illustrated, one spacer 47 is positioned between baffle 42 and baffle 43. The spacer 47 has the same configuration as the housing 30 so that the outer circumference of the spacer 47 is flush against the inner surface 33 of the housing 30. Cumulatively, the length of any spacers 47 and the annuli 46 of the baffles 43 can be approximately 25% to 75% of the length of the housing 30.

The baffles 41-43 can be provided with ports or relief sections 48 that assist in dissipating combustion gases and sound energy. As illustrated, there are four ports 48. Two of the ports 48 are formed on the frusto-conical sections 45 of baffles 41-42. The other two ports 48 are formed in the axial bore 44 of baffle 41. The baffles 41-43 can also be provided with screw thread 49 that is complementary to the screw thread 37 of the housing 30. The screw thread 49 is used to secure the baffle core 40 to the housing 30. As illustrated, the screw thread 49 is provided on baffle 43. Other engagement mechanisms can be used to secure the baffle core 40 to the housing 30.

The front cap 50 has a disk-like configuration and can be solid with the exception of the bore 53 that extends longitudinally between a first end 51 and the second end 52. The bore 53 is sized so that the projectile can pass through it unobstructed. An outer surface 54 of the front cap 50 can be provided with screw thread 55 that is complementary to the screw thread 37 of the housing 30. If screw thread 49 is used to secure the baffle core 40 to the housing 30, the front cap 50 can be a jam nut to help prevent the baffle core 40 from unscrewing when the sound suppressor 10 is in use.

The sound suppressor 10 is assembled by inserting the second end 22 of the end piece 20 into the bore 38 at the first end 31 of the housing 30 until the lip 28 of the end piece 20 abuts the first end 31 of the housing 30. The screw thread 23 of the end piece 20 can be engaged with the screw thread 36 of the housing 30. The baffle core 40 is inserted into the bore 38 at the second end 32 of the housing 30 until the baffle core 40 is adjacent to the second end 22 of the end piece 20. The annulus 46 of the baffle 41 closest to the first end 31 of the housing 30 may abut the second end 22 of the end piece 20. The screw thread 49 of the baffle core 40 can be engaged with the screw thread 37 of the housing 30. The front cap 50 can then be inserted into the bore 38 at the second end 32 of the housing 30. The annulus 46 of the baffle 43 furthest from the first end 31 of the housing may abut the first end 51 of the front cap 50. The screw thread 55 of the front cap 50 can be engaged with the screw thread 37 of the housing 30. Once assembled, any spacers 47, the annuli 46 of the baffles 43, and the end piece 20 can cover the entire inner surface 33 of the housing 30 to protect the housing 30 from the expanding gases and other combustion by-products that are emitted by the firing of the projectile.

To disassemble the sound suppressor 10, a tool such as a wrench can be used to disengage the screw thread 55 of the front cap 50 from the screw thread 37 of the housing 30 and remove the front cap 50 from the bore 38 of the housing 30. The baffle core 40 can then be removed from the bore 38 of the housing 30 after disengaging the screw thread 49 of the baffle core 40 from the screw thread 37 of the housing 30. The end piece 20 can also be removed from the bore 38 of the housing 30 after disengaging the screw thread 23 of the end piece 20 from the screw thread 36 of the housing 30. Once disassembled, damage to the end piece 20, the baffle core 40, and/or the front cap 50 can be repaired before the sound suppressor is re-assembled as previously described.

While the invention has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A sound suppressor for a firearm having a serial number, the sound suppressor comprising:

an integrally formed housing having an outer surface, an inner surface, a first screw thread formed in the inner surface of the housing at a first longitudinal end of the housing, and a second screw thread formed in the inner surface of the housing at a second longitudinal end of the housing, wherein the serial number is provided on the outer surface of the housing;

a first end part that is threadedly connected to the first screw thread;

a second end part that is threadedly connected to the second screw thread; and baffle core components that are disposed in the housing between the first end part and the second end part and are removable from the housing, the baffle core components each having a cylindrical portion, wherein at least one of the baffle core component has a third screw thread formed on a section of the cylindrical portion and the third screw thread is threadedly connected to the second screw thread, and wherein the cylindrical portions of the baffle core components, the first end part, and the second end part cooperate to cover an entirety of the inner surface of the housing to protect the housing from gases emitted by the firearm during firing of a projectile.

2. The sound suppressor of claim 1, wherein the first end part has a lip, a body having a substantially tubular configuration, a first end, and a second end opposing the first end, wherein the lip abuts the first longitudinal end of the housing, the body extends from the lip to the second end and is substantially flush against the inner surface of the housing when the first end part is at least partially disposed within the housing, and the body is at least 25 percent of a longitudinal length of the housing.

3. The sound suppressor of claim 2, wherein the first end part and the second end part each abut a respective cylindrical portion from one of the baffle core components when the first end part, the second end part, and the baffle core components are at least partially disposed within the housing.

4. The sound suppressor of claim 2, further comprising:

a spacer having a substantially tubular configuration, wherein the spacer is positioned between the first end part and the second end part.

5. The sound suppressor of claim 4, wherein the body of the first end part is substantially flush against the inner surface of the housing, outer surfaces of the cylindrical portions of the baffle core components, and an outer surface of the spacer are substantially flush against the inner surface of the housing, and an outer surface of the second end part is substantially flush against the inner surface of the housing.

6. The sound suppressor of claim 4, wherein a cumulative longitudinal length of the cylindrical portions of the baffle core components and the spacer is between 25 percent and 75 percent of a longitudinal length of the housing.

7. The sound suppressor of claim 1, wherein an axial bore of the housing, an axial bore of the first end part, axial bores of the baffle core components, and an axial bore of the second end part are coaxially aligned.

8. The sound suppressor of claim 7, wherein the inner surface of the housing is outside of a communication path formed between the axial bore of the first end part, the axial bores of the baffle core components, and the axial bore of the second end part.

9. The sound suppressor of claim 1, wherein the second end part is removable from the housing.

10. The sound suppressor of claim 1, wherein the first end part, the second end part, and the baffle core components define an axial bore that allows passage of the projectile and receives the gases emitted by the firearm, and the first end part, the second end part, and the cylindrical portions of the baffle core components physically isolate the axial bore from the inner surface of the housing.

11. The sound suppressor of claim 1, wherein an outer surface of the first end part, outer surfaces of the cylindrical portions of the baffle core components, and an outer surface of the second end part are substantially flush with the inner surface of the housing.

* * * * *